United States Patent [19]

Gordon et al.

[11] Patent Number: 4,794,956

[45] Date of Patent: Jan. 3, 1989

[54] AIR CONDUIT FOR MANHOLE

[75] Inventors: Russell B. Gordon; Jimmy A. Gordon, both of Atlantic Beach, Fla.; Marion W. Smith, Daphne, Ala.

[73] Assignee: Saddle Vent Inc., Atlantic Beach, Fla.

[21] Appl. No.: 71,886

[22] Filed: Jul. 10, 1987

[51] Int. Cl.[4] ..... F15D 1/04

[52] U.S. Cl. ..... 138/39; 138/106

[58] Field of Search ..... 138/39, 103, 106, 107, 138/108, 109, 111, 115, 116, 122, 178; 285/179; 52/20; 98/1, 29, 37, 49, 50, 87, DIG. 7; 248/49, 56, 58, 60, 66

[56] References Cited

U.S. PATENT DOCUMENTS

| | | | |
|---|---|---|---|
| 396,773 | 1/1889 | Smith | 285/179 X |
| 1,191,621 | 7/1916 | Schmidt | 285/179 X |
| 1,782,779 | 11/1930 | Fullman | 285/179 X |
| 2,056,782 | 10/1936 | Fosdick | 138/89 |
| 2,364,144 | 12/1944 | Hunsaker | 98/32 |
| 3,093,056 | 7/1963 | Rosenfeld | 98/35 |
| 3,610,524 | 10/1971 | Wallen | 98/33.1 |
| 3,757,664 | 9/1973 | Jalbert | 98/37 |
| 3,894,302 | 7/1975 | Lasater | 138/89 X |
| 4,023,833 | 5/1977 | Wellard | 285/179 |
| 4,285,269 | 8/1981 | Pelsue et al. | 98/33.1 |
| 4,463,779 | 8/1984 | Wink et al. | 138/133 X |

FOREIGN PATENT DOCUMENTS

| | | | |
|---|---|---|---|
| S 3167 | 12/1955 | Fed. Rep. of Germany . | |
| 259758 | 8/1928 | Italy | 138/39 |

*Primary Examiner*—Werner H. Schroeder
*Attorney, Agent, or Firm*—Nixon & Vanderhye

[57] ABSTRACT

Air ventilation conduit for passing through manhole the conduit having a central section with a cross section having the shape of a crescent or a segment of a circle where it passes through the manhole to provide a minimum of obstruction for men and equipment passing through the manhole, cylindrical outer sections of the conduit for connection to flexible hose, and intermediate sections of varying cross section to connect the central section to the cylindrical outer sections offset away from the manhole.

25 Claims, 8 Drawing Sheets

AIR CONDUIT FOR MANHOLE

BACKGROUND OF THE INVENTION

Tanks, sewers, and other enclosures that must be entered periodically require some type of air ventilation system for the men working in the enclosure. Without some type of air ventilation the workers would be required to wear respirators. The current apparatus used today normally includes an air pump outside the enclosure and an 8-inch flexible hose leading into the enclosure. The normal 24 inch manhole is barely large enough to allow a person to enter the enclosure with tools and/or materials. When an 8-inch hose is also in the manhole it may prevent such a person from entering the enclosure, and it always provides an obstruction that tends to catch tools on the man's belt with the possibility of damaging the hose or dropping tools on a worker already in the enclosures.

It is an object of this invention to provide an improved air conduit for ventilating an enclosure with a manhole entrance. It is another object of this invention to provide such an air conduit which is flattened in the area where it passes through the manhole. Still other objects will appear in the more detailed description which follows.

BRIEF SUMMARY OF THE INVENTION

This invention relates to a conduit for passing air through a manhole with a minimum of obstruction at the manhole, the conduit comprising a central section having a cross section in the shape of a crescent or a segment of a circle, two intermediate sections, attached respectively to each end of said central section and having cross sectional shapes varying from the shape of the central section at the juncture with said central section tapering to a circular shape at the outer end of said intermediate section, and two outer cylindrical sections, respectively attached to the outer end of each of said intermediate sections, said outer sections externally being aligned on a common axis.

In preferred embodiments of the invention the outer surface of the central section is cylindrical and has substantially the same diameter as the diameter of the manhole in which the conduit is used; and a means are included at the outer surface of the central section so that the conduit may be hung from the manhole opening.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
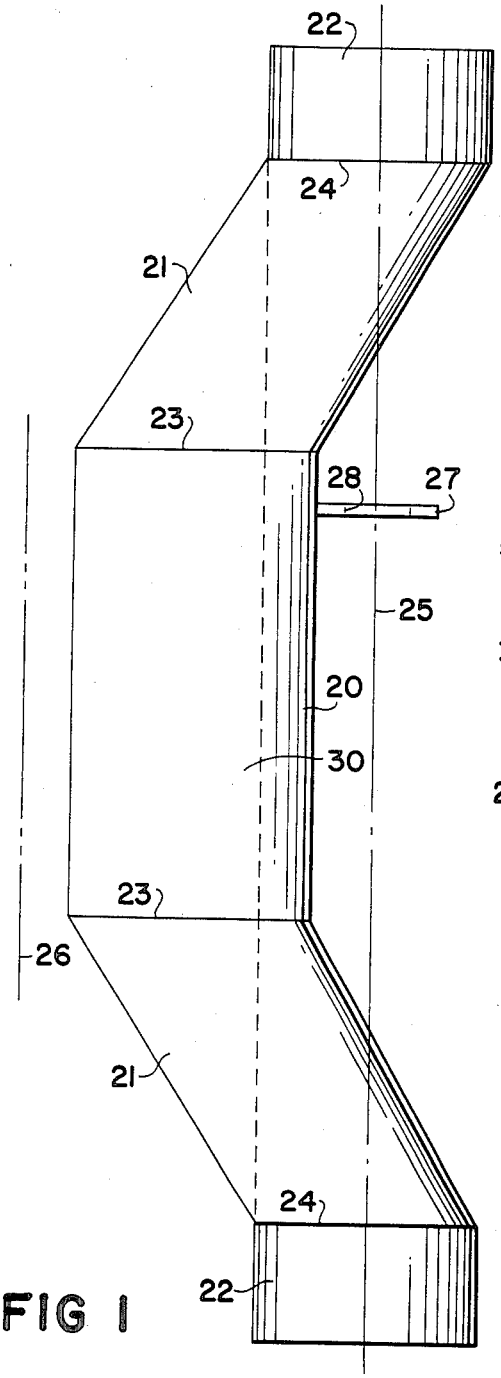
FIG. 1 is a front elevational view of one embodiment of the conduit of this invention.
Figure 2:
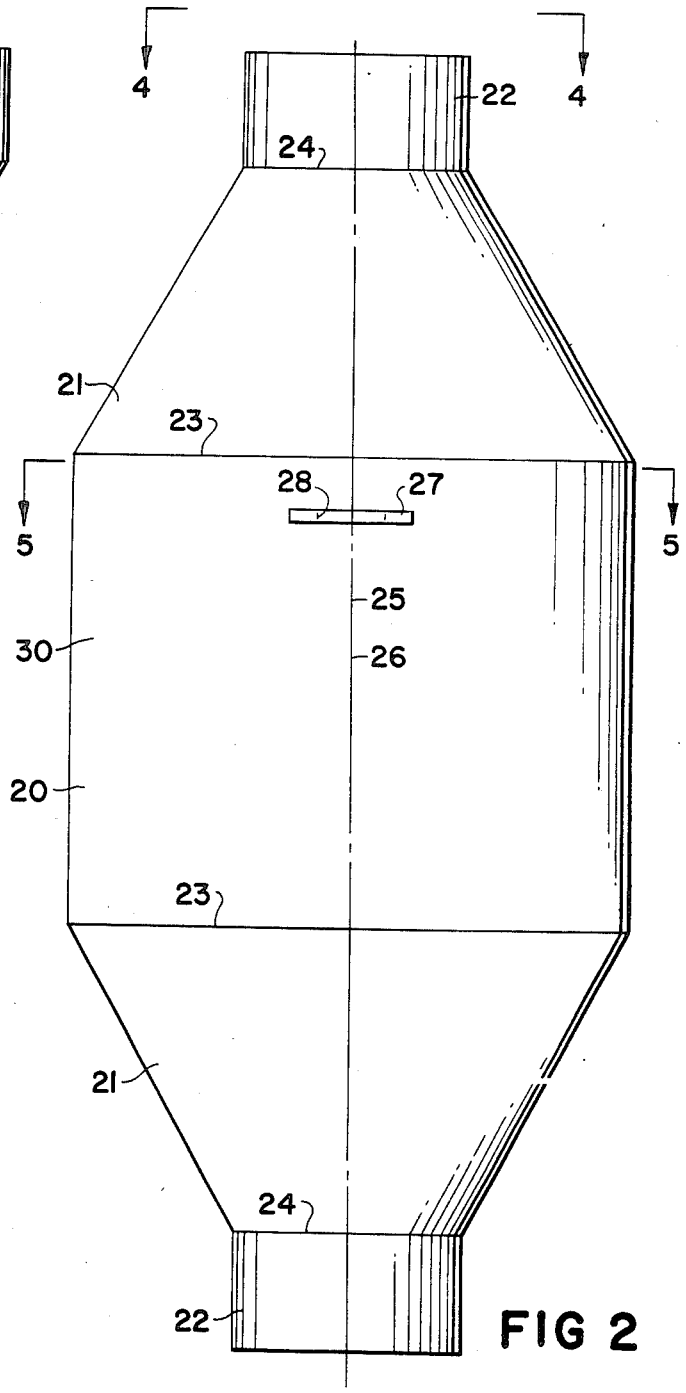
FIG. 2 is a top plan view of the conduit of FIG. 1.

The structural details of the conduit of this invention are best understood by reference to the attached drawings.

The conduit is comprised of five sections connected end to end. There is a central section 20 connected at each end to an intermediate section 21, which in turn are connected to two outer sections 22. Preferably, the conduit is made of thin, light weight material such as sheet metal, transparent plastic, or the like.

Central section 20 has a cross section 20 with the shape of a crescent or a segment of a circle, outer surface 30 being cylindrical and inner surface 31 being cylindrical when the cross section is crescent shaped, or being a flat plane, when the cross section i a segment of a circle. FIGS. 1–5 show a crescent shaped cross section and FIGS. 6–13 show a cross section which has the shape of a segment of a circle. Inner surface 31 may be of any selected shape, not limited to being a flat plane or being cylindrical; it can be two or more intersecting planes, an irregular curved surface, or the like. In the most preferred embodiment, outer surface 30 fits snugly into the manhole opening. In other words, the diameter of outer surface 30 is substantially the same as the diameter of the manhole opening. Throughout the length of central section 20 the shape of the cross section preferably is the same, although it is operable for this shape to be variable. The central axis 26 of central section 20 is the center of the circle represented by outer surface 30.

Figure 4:
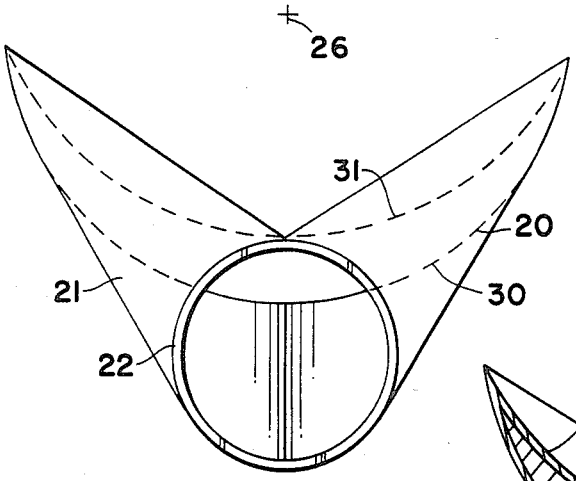
FIG. 4 is an end elevational view looking in the direction of 4—4 of FIG. 2.
Figure 5:
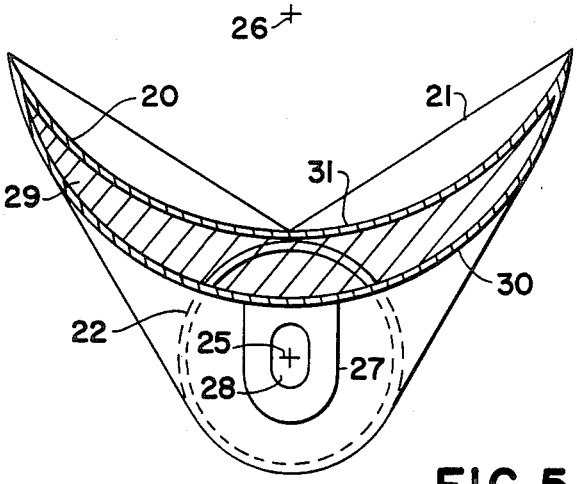
FIG. 5 is a cross sectional view taken at 5—5 of FIG. 2.
Figure 6:
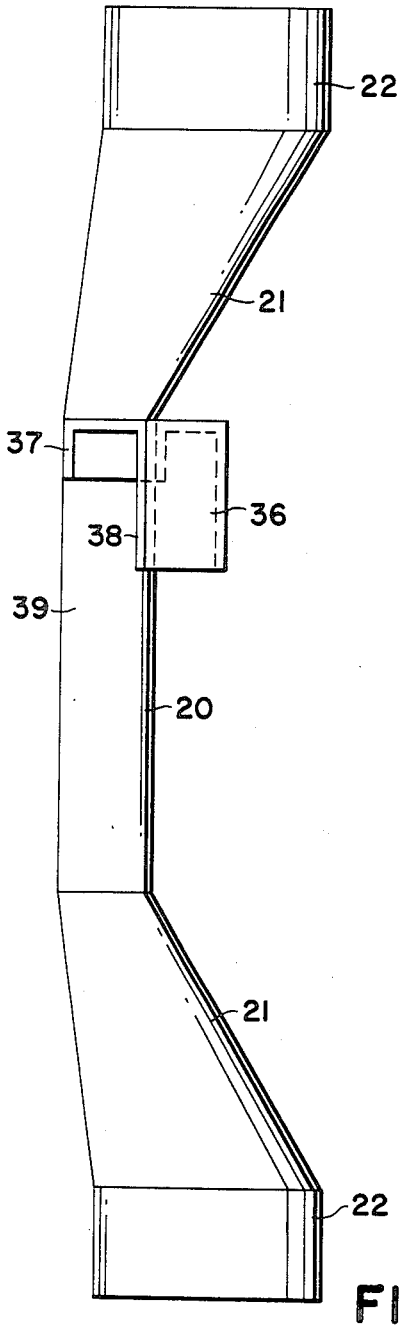
FIG. 6 is a front elevational view of a second embodiment of the conduit of this invention.
Figure 7:
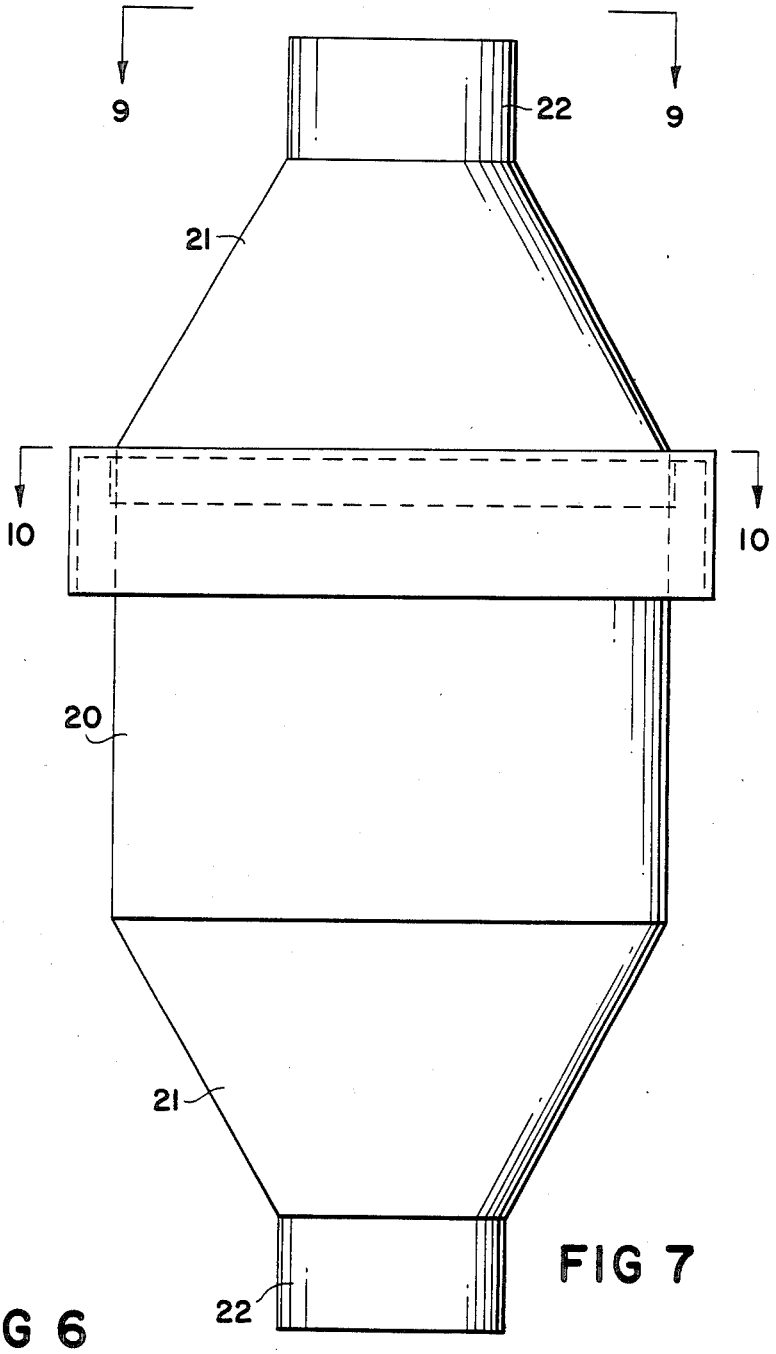
FIG. 7 is a top plan view of the conduit of FIG. 6.
Figure 8:
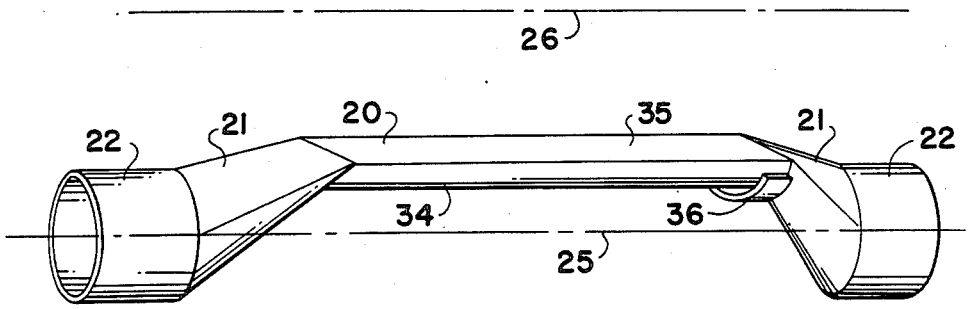
FIG. 8 is a perspective view of the conduit of FIG. 6.
Figure 9:
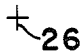
FIG. 9 is an end elevational view looking in the direction of 9—9 of FIG. 7.
Figure 9:
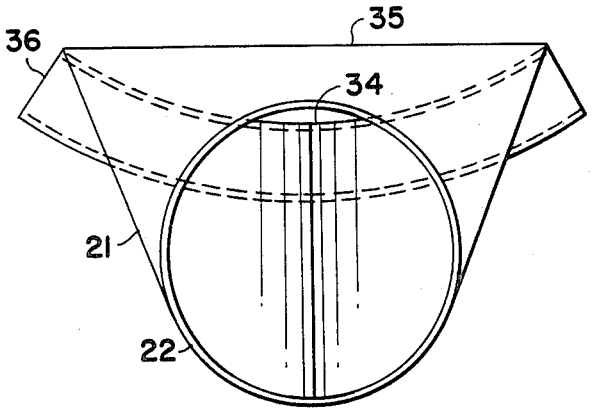
Figure 10:
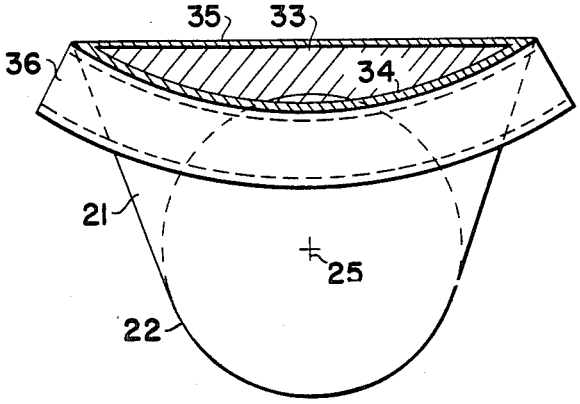
FIG. 10 is a cross sectional view taken at 10—10 of FIG. 7.

Transition or intermediate sections 21 join central section 20 at juncture lines 23 at one end and join outer sections 22 at juncture lines 24 at the other end. At juncture line 23 the cross section of intermediate section 21 is the same shape as that of central section 20, and at juncture line 24 is a circle. In between juncture lines 23 and 24 the cross sectional shape changes at every position tapering along longitudinal axis 32 from a crescent or segment to a circle. The unusual wing-shaped structure or butterfly-shaped structure of intermediate sections 21 is shown in FIGS. 4 and 5 where the cross sectional shape of central section 20 is a crescent.

Outer sections 22 are cylindrical, preferably about 8 inches in diameter so as to fit already existing equipment. Any other diameter is, of course, operational. Both outer sections 22 are preferably aligned on a common longitudinal axis 25 parallel to axis 26 of central section 20, although this is not a critical feature. Outer sections 22 may not be aligned on a common axis: and, if aligned, their axis need not be parallel to axis 26. Each outer section 22 is attachable to flexible hose to lead to a pump at one end and to lead to any position in the enclosure desired by the persons therein.

One of the important features of this conduit is that the cross sectional shapes at any location from one end to the other of the conduit are such that the cross sectional areas are substantially constant. This is important so that the air being pumped through the conduit has no obstruction and will flow smoothly. Thus the area of crescent cross section 29 (FIG. 5), shown crosshatched, is the same as the area of the circle at 22.

A second special feature of this conduit is that each outer section 22 be considerably offset from the manhole, which generally is the same as axis 26 of central section 20. Under these conditions, the offsetting of outer sections 22 places them as far outside of the perimeter of the manhole as can practically be permitted. The purpose of this arrangement is to remove as much as possible of the conduit from the manhole area so as to provide a minimum obstruction to a person or equipment entering or leaving through the manhole. The crescent cross section 29 of central section 20 is made as thin as possible; i.e., inside surface 31 is as close as possible to outside surface 30, so as to provide a minimum obstruction for a person entering or leaving the manhole.

A tab 27 with an opening 28 passing therethrough is shown projecting laterally outwardly from the outside surface 30 of central section 20. This is provided to cooperate with a pin placed on some manholes for the purpose of suspending equipment therefrom. The conduit can hang vertically on such a pin when the axis of the manhole is vertical. If such a pin is not found on the manhole in the areas of use of this conduit, other means may be provided to make the conduit attachable to the manhole. For example, a tab without an opening could be attached to the manhole rim by a clamp. A pin on the conduit could be attachable to a hole or recess in the vicinity of the manhole rim. Other similar attaching means are also operable.

In FIGS. 6–10 there is shown a second embodiment of the conduit of this invention. The central section 20, intermediate sections 21, and outer sections 22 are substantially the same as those described above with respect to FIGS. 1–5 except that the cross section 33 of central section 20 is a segment of a circle (shown crosshatched in FIG. 10). Outer surface 34 of cross section 33 is cylindrical with a diameter substantially the same as the diameter of the manhole. Inner surface 35 is a flat plane. As mentioned previously inner surface 35 may be two or more intersecting planes, or a curved surface.

The other feature of this second embodiment is the means for hanging the conduit on the manhole. In this embodiment the means is an arcuate length of a channel member 36 having a short leg 37 welded to outer surface 34 and a longer leg 38 adapted to hang over the rim of a manhole. Open side 39 of channel member 36 faces downwardly to permit the hanging of the conduit on a manhole. The length of member 36 is shown as extending over the entire width of outer surface 34, although it may be appreciated that this is not critical. A shorter length may be employed, or alternatively, a plurality of channel sections may be used in place of one longer section. This style of hanger means is particularly useful when the manhole has an upstanding rim or is provided with one as is the case with some telephone manholes.

Figure 11:
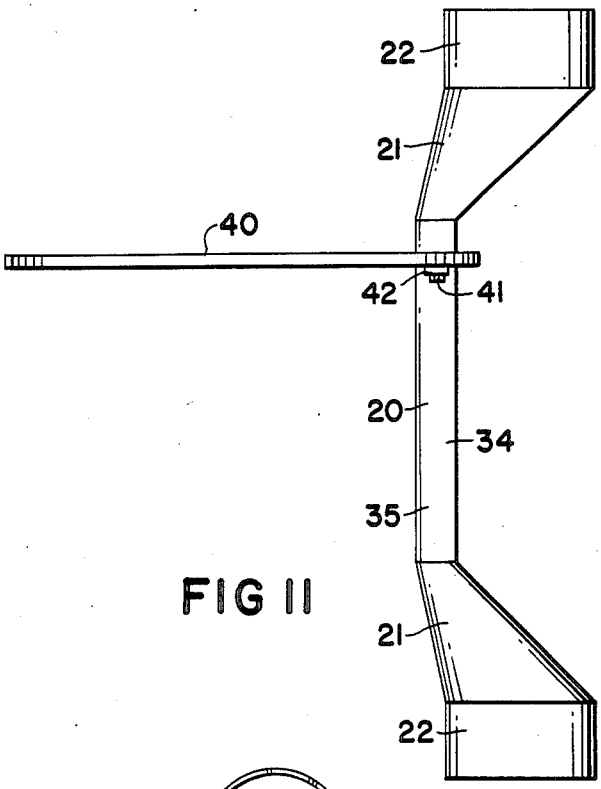
FIG. 11 is a front elevational view of a third embodiment of the conduit of this invention.
Figure 12:
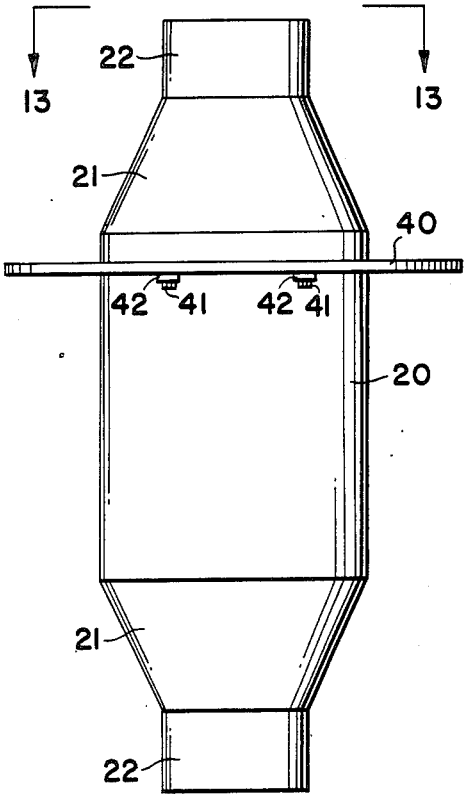
FIG. 12 is a top plan view of the conduit of FIG. 11.
Figure 13:
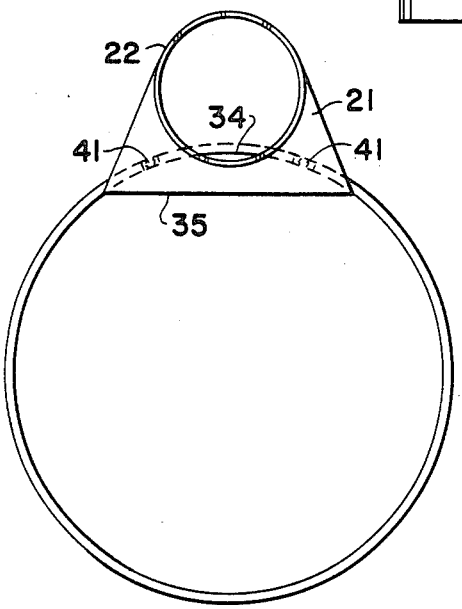
FIG. 13 is an end elevational view looking in the direction of 13—13 of FIG. 12.

In FIGS. 11–13 there is illustrated a third embodiment where the hanger means is a ring 40 which snugly fits around outer surface 34 and is rigidly attached thereto by welding or by bolt means 41 attached to flange means 42 welded to outer surface 34. In one preferred embodiment ring 40 is attached to central section 20 by a hinge 43 eliminating bolts 41 and flanges 42 which permits movement of ring 40 from the horizontal operational position shown in FIGS. 11–13 to a folded position 44 for carrying or for storage. This type of hanger means may be employed on manholes which have a channel rim into which ring 40 fits.

In some instances, e.g., on ships, the manhole may be oval in shape. In this instance the conduit of this invention will fit into either end of the oval and employ whatever type of hanger means is available, normally, a tab to hang on a pin around the manhole, as in FIGS. 1–5.

It will be appreciated that the embodiment of FIGS. 6–10 and 11–13 are most suitable for inground manholes particularly since the neck or throat of the manhole often must be extended by additional road covering or dirt fill, etc. Thus the length of the central section is of any normal length adapted to span the neck or throat of a manhole as would be understood by those having skill in the art.

Figure 14:
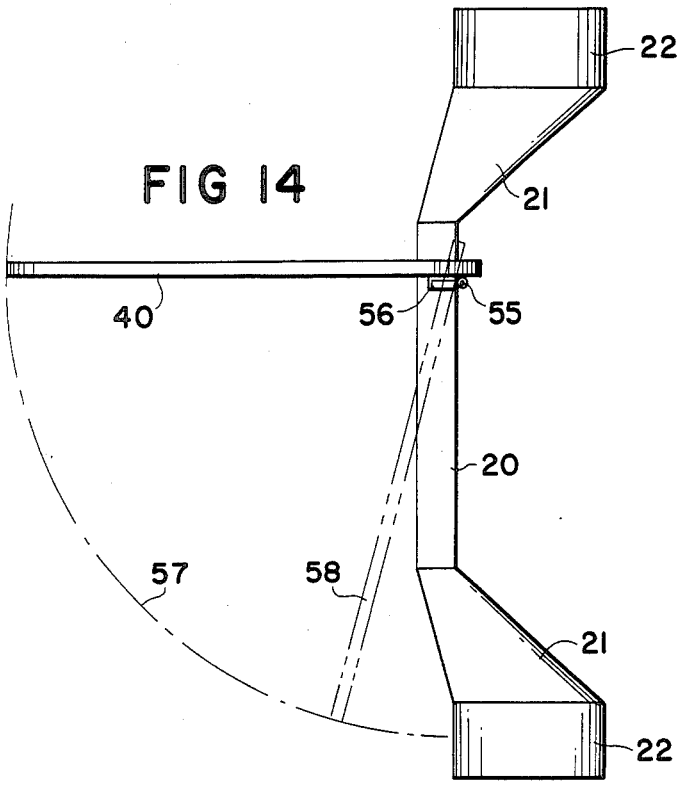
FIG. 14 is a view of an alternative arrangement of the conduit of FIG. 11.
Figure 15:
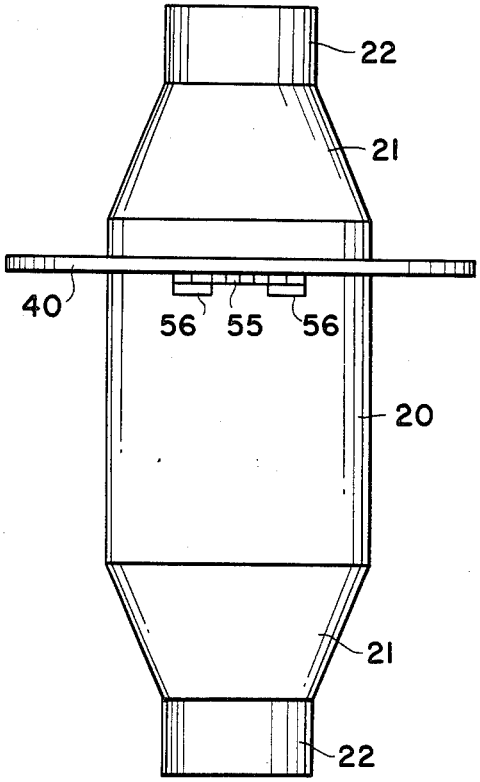
FIG. 15 is a view of an alternative arrangement of the conduit of FIG. 12.
Figure 16:
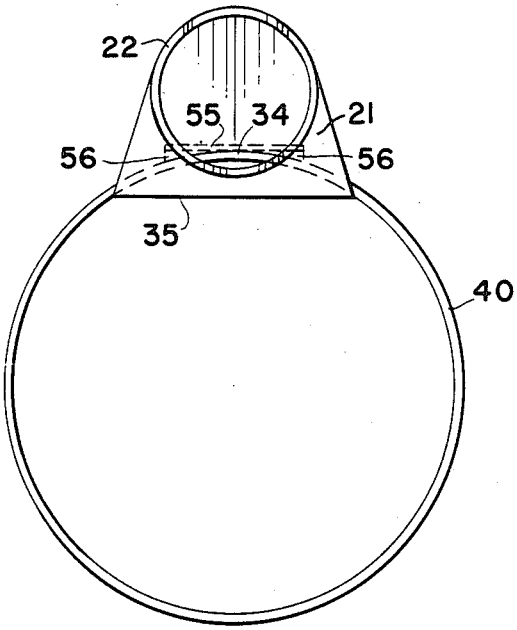
FIG. 16 is a view of an alternative arrangement of the conduit of FIG. 13.
Figure 18:
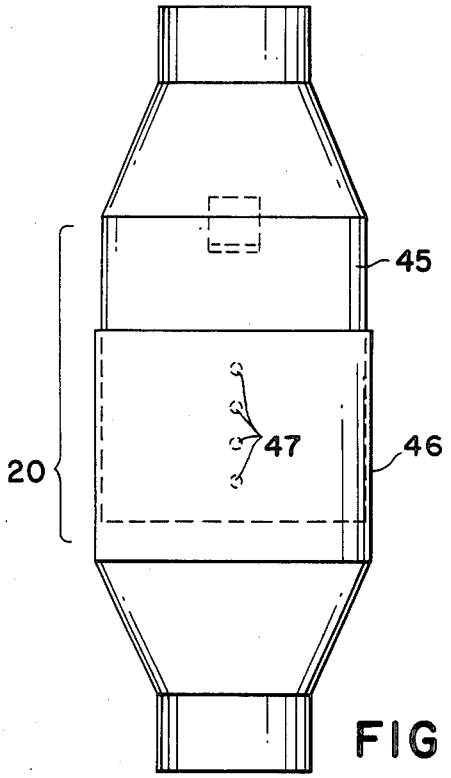
FIG. 18 is a top plan view of the conduit of FIG. 17.

In FIGS. 14–16 there is shown an alternative embodiment to that of FIGS. 11–13. Except for the mounting or ring 40, everything else is identical to the structure of FIGS. 11–13. In FIGS. 14–16 ring 40 is mounted on a hinge 55 attached to two flanges 56 which are welded to surface 34. Hinge 55 pivots through the quadrant 57 shown in FIG. 14, i.e., ring 40 cannot move above the horizontal as shown in solid lines in FIGS. 14 and 15 but can pivot downwardly to position 58 shown in dotted lines in FIG. 14. This permits the conduit and ring 40 to be folded into a more compact structure for storage.

Figure 3:
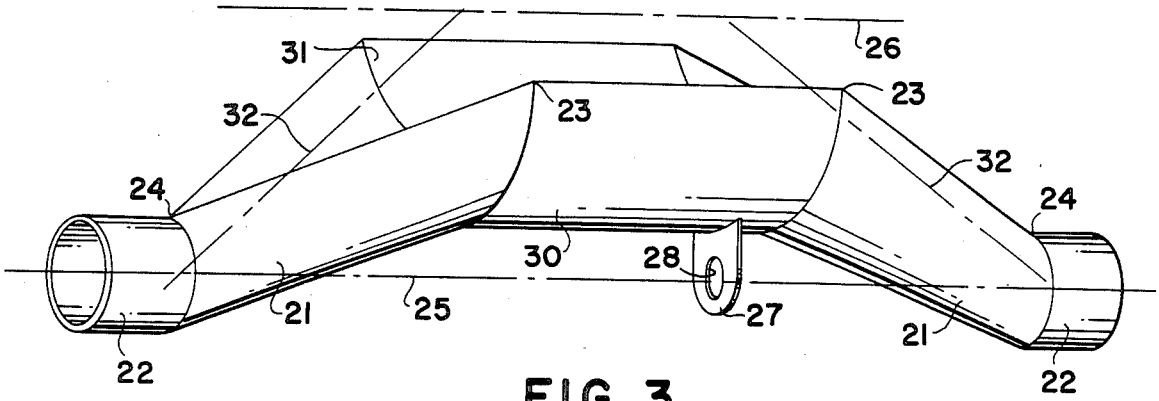
FIG. 3 is a perspective view of the conduit of FIG. 1.
Figure 17:
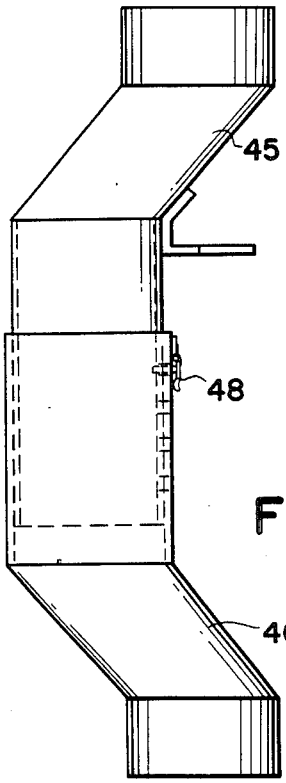
FIG. 17 is a front elevational view of the conduit of this invention having an adjustable central section.
Figure 19:
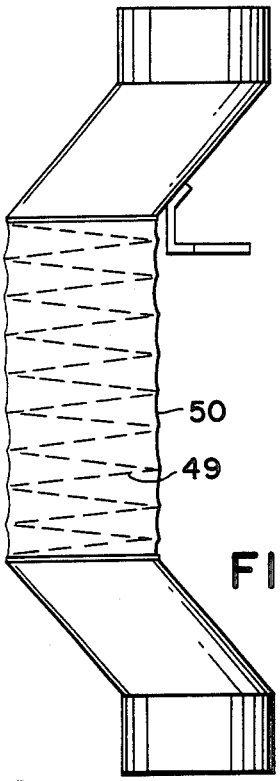
FIG. 19 is a front elevational view of the conduit of this invention having a second type of adjustable central section.
Figure 20:
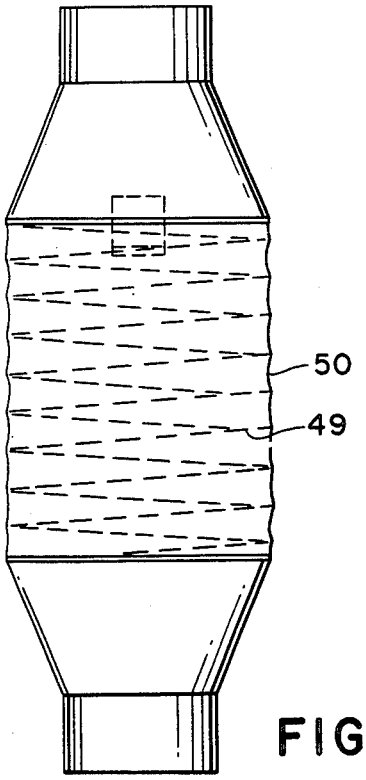
FIG. 20 is a top plan view of the conduit of FIG. 19.
Figure 21:
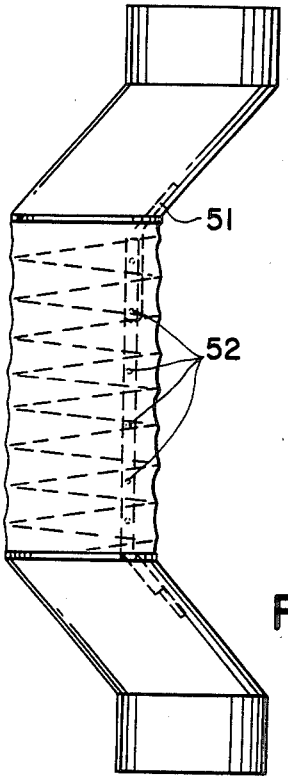
FIG. 21 is a partial front elevational view of the conduit of FIG. 19 showing how the adjustable central section is maintained in its long position.
Figure 22:
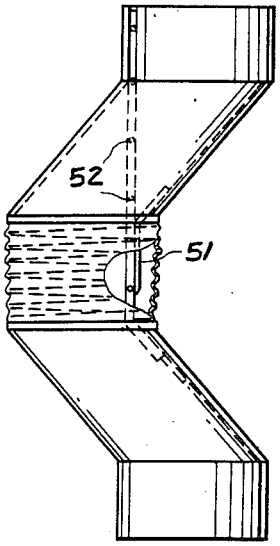
FIG. 22 is a partial front elevational view of the conduit of FIG. 19 showing how the central section is maintained in its short position.
Figure 23:
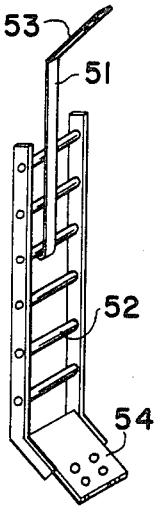
FIG. 23 is an enlarged perspective view of the means of FIGS. 21 and 22 for holding the central section in a selected length.

It is advantageous to have central section 20 adjustable in its length, i.e., the distance from one juncture 23 to the other juncture 23 in FIG. 3. This is an important feature because some manholes may extend through several layers of old roadways while manholes in relatively new roads would have only a short distance to extend through the road bed. As shown in FIGS. 17 and 1 central section 20 may be made telescopic with upper section 45 sliding inside lower section 46. A series of aligned holes 47 in both of sections 45 and 46 are matched with a keeper stud 48 to maintain the length of central section 20 to any selected amount. In another embodiment (see FIGS. 19 and 20) central section is made expandable and contractable by the combination of a helical spring 49 and a tubular cover sheet 50 which is air-impermeable such as textile fabric, rubber, plastic, or the like. The selected length is preferably maintained by the combination of a hook member 51 and a ladder member 52 with several cross bars which can be selectively connected to adjust to a long length as shown in FIG. 21 or a short length as shown in FIG. 22 or any other position of length. The preferred structure is shown in FIG. 20 where hook member 51 is attached to upper section 45 by bolting upper end 53 of hook member 51 thereto, and by bolting plate 54 to lower section 46.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A conduit for supplying air to an enclosure through a manhole with minimum obstruction to a person passing through the manhole, the conduit comprising an elongated, substantially straight central section having a cross section in the general shape of a thin crescent or a thin segment of a circle so as to minimize obstruction within the manhole through which said central section is adapted to be received, two intermediate sections, attached respectively to each end of said central section and having cross sectional shapes varying from the shape of said central section at the juncture with said central section tapering to a circular shape at the outer end of said intermediate section, and two outer cylindrical sections, respectively attached to the outer end of each of said intermediate sections, said intermediate sections being angularly disposed with respect to said substantially straight central section such that said outer cylindrical sections are directed away from the manhole when said central section is disposed in place within the manhole.

2. The conduit of claim 1 wherein said central section includes an outer surface, provided with means thereon for attaching said conduit to the manhole.

3. The conduit of claim 2 wherein said means on said outer surface includes a tab with an opening therethrough.

4. The conduit of claim 2 wherein said means on said outer surface includes an arcuate channel member mounted on said outer surface of said central section and generally laterally with respect thereto.

5. The conduit of claim 2 wherein said means attaching includes a circular ring member attached to said outer surface of said central section with said circular ring member disposed laterally with respect to said central section.

6. The conduit of claim 5 further comprising hinge means for attaching said ring member to said central section.

7. The conduit of claim 1 wherein said central section includes a longitudinal axis, said outer cylindrical sections being aligned on a common axis which is substantially parallel to said longitudinal axis of said central section.

8. The conduit of claim 1 wherein the manhole is substantially circular and has a first diameter, and wherein said central section has an outer surface which is cylindrical with a second diameter substantially the same as said first diameter.

9. A conduit for passing air through a manhole with a minimum of obstruction at the manhole, the conduit comprising a central section having a cross section in the general shape of a thin crescent or a thin segment of a circle to minimize obstruction in the manhole through which said central section is adapted to pass, said central section being adjustable in length; two intermediate sections, attached respectively to each end of said central section and having cross sectional shapes varying from the shape of said central section at the juncture with said central section tapering to a circular shape at the outer end of said intermediate section; and two outer cylindrical sections, respectively attached to the outer end of each of said intermediate sections, said intermediate sections being angularly disposed with respect to said central section such that said outer cylindrical sections are directed away from the manhole when said central section is disposed through the manhole.

10. The conduit of claim 9 wherein said central section comprises a plurality of telescopically slidable portions for lengthwise adjustment.

11. The conduit of claim 9 wherein said central section comprises a helical spring covered by a tubular air-impermeable sheet material.

12. A conduit for conducting air through a manhole to the interior of an enclosure wherein said manhole is the entrance/exit, said conduit comprising five longitudinal tubular sections joined end-to-end, including one central section, two intermediate sections and two outer sections; said outer sections being cylindrical pipes, said central section being a portion of a cylinder having the general cross section of a crescent or a segment of a circle over the entire length of said central portion and having a longitudinal axis adapted to be placed substantially parallel to the axis of said manhole; said intermediate sections being connected, respectively, to each end of said central section, with the other end of each of said intermediate sections being connected to one of said outer sections, the cross section of each of said intermediate sections changing throughout its length from the shape of said central portion at one end thereof to a circle at the other end thereof, the relative sizes of the several cross sections being such that the cross sectional area of said central section, of each of said intermediate sections at any location, and of each of said outer sections being substantially the same.

13. The conduit of claim 12 wherein said central section is elongated and includes a longitudinal axis, said outer sections being substantially aligned on a common axis which is substantially parallel to said longitudinal axis of said central section.

14. The conduit of claim 12 further comprising means connected outwardly of said central section for releaseable attachment of said conduit to a manhole.

15. The conduit of claim 14 wherein said means connected outwardly of said central section includes a tab with an opening therethrough.

16. The conduit of claim 14 wherein said means connected outwardly of said central section includes an arcuate channel member mounted on and laterally of said central section.

17. The conduit of claim 14 wherein said means includes a circular ring member attached outwardly of said central section with said circular ring member being disposed laterally of said central section.

18. The conduit of claim 17 further comprising hinge means for attaching said ring member to said central section.

19. The conduit of claim 12 wherein said central section has an outer surface which is cylindrical having a diameter substantially equal to a diameter of a manhole.

20. A conduit for passing air through a manhole with a minimum of obstruction at the manhole, the conduit comprising a central section having a cross section in the general shape of a thin crescent or a thin segment of a circle to minimize obstruction in the manhole through which said central section is adapted to pass; two intermediate sections, attached respectively to each end of said central section and having cross sectional shapes varying from the shape of said central section at the juncture with said central section tapering to a circular shape at the outer end of said intermediate section; and two outer cylindrical sections, respectively attached to the outer end of each of said intermediate sections, said intermediate sections being angularly disposed with respect to said central section such that said outer cylindrical sections are directed away from the manhole when said central section is disposed through the manhole; and wherein a cross-sectional area of said conduit at any position throughout its length is at least as large as the cross-sectional area of each said outer section.

21. A conduit for passing air through a manhole with a minimum of obstruction at the manhole, the conduit comprising a central section having a cross section in the general shape of a thin crescent or a thin segment of a circle to minimize obstruction of the manhole through which said central section is adapted to pass; two intermediate sections, attached respectively to each end of said central section and having cross sectional shapes varying from the shape of said central section at the juncture with said central section tapering to a circular shape at the outer end of said intermediate section; and two outer cylindrical sections, respectively attached to the outer end of each of said intermediate sections, said intermediate sections being angularly disposed with respect to said central section such that said outer cylindrical sections are directed away from the manhole when said central section is disposed through the manhole, and wherein said central section has an adjustable length to span a throat of the manhole to dispose each of said outer sections generally laterally offset from a wall forming the throat of the manhole.

22. The conduit of claim 21 wherein said central section includes a pair of lengthwise telescopically slidable portions to adjust the length thereof.

23. The conduit of claim 22 wherein one of said slidable portions is outside another of said slidable portions, a spring biased stud member attached to said one slidable portion, and a plurality of holes in both said slidable portions, selectively alignable and adapted to receive said stud member therethrough.

24. The conduit of claim 21 wherein said central section includes a helical spring covered by a tubular air-impermeable sheet material.

25. The conduit of claim 24 which additionally comprises a hook member attached to one of said intermediate sections and a ladder member attached to the other of said intermediate sections, said hook member and said ladder member adapted to be releasably attachable to each other to adjust the length of said central section.

* * * * *